US005399038A

United States Patent [19]

Clary

[11] Patent Number: 5,399,038

[45] Date of Patent: Mar. 21, 1995

[54] DUAL LINE SLIP PRINTER

[75] Inventor: John G. Clary, Pasadena, Calif.

[73] Assignee: Addmaster Corporation, Monrovia, Calif.

[21] Appl. No.: 34,752

[22] Filed: Mar. 18, 1993

[51] Int. Cl.[6] ..... B41J 13/10

[52] U.S. Cl. ..... 400/628; 400/645; 400/645.4

[58] Field of Search ..... 400/120, 600, 602, 628, 400/317.1, 323, 645, 645.4, 48; 271/269, 271, 903

[56] References Cited

U.S. PATENT DOCUMENTS

| | | | |
|---|---|---|---|
| 4,143,981 | 3/1979 | Hansen et al. | 400/628 |
| 4,431,323 | 2/1984 | Kulow | 271/271 |
| 4,540,298 | 9/1985 | Kulow | 271/271 |
| 4,676,682 | 6/1987 | Schacht | 400/628 |
| 4,944,620 | 7/1990 | Scozzafava et al. | 400/607 |
| 5,080,513 | 1/1992 | Clary | 400/605 |
| 5,209,591 | 5/1993 | Mizutani et al. | 400/645 |
| 5,248,210 | 9/1993 | Schulz | 271/271 |
| 5,258,773 | 11/1993 | Arakaw et al. | 400/323 |
| 5,294,204 | 3/1994 | Clary | 400/636 |

FOREIGN PATENT DOCUMENTS

| | | | |
|---|---|---|---|
| 4035970 | 2/1992 | Japan | 400/602 |

*Primary Examiner*—Edgar S. Burr
*Assistant Examiner*—John S. Hilten
*Attorney, Agent, or Firm*—Fred N. Schwend

[57] ABSTRACT

A dual line slip printer wherein a slip is dropped into a chute to bottom against a supporting member and a serially operated inkjet print head is moved along the length of the slip to print a line of type characters and is then returned to print a second line of characters. As the print head reaches the end of its travel it actuates a camming member to raise the support member to move the slip from one level to another so that the second row of characters will be spaced vertically from the first.

4 Claims, 2 Drawing Sheets

FIG. 1
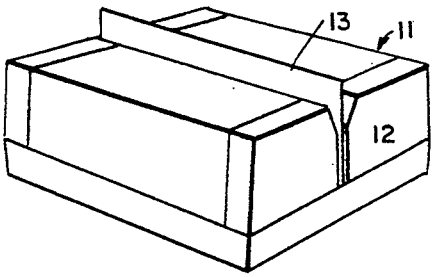
FIG. 2
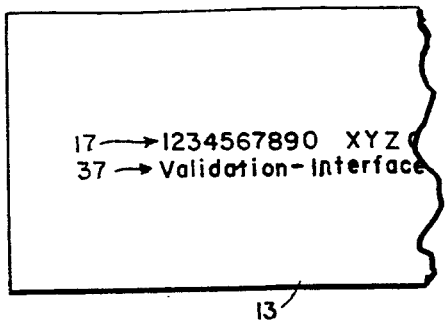
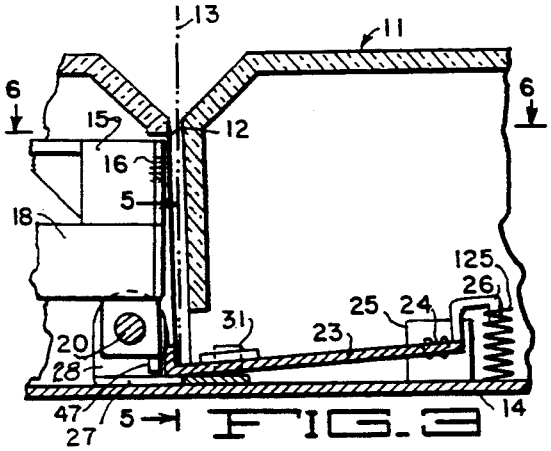
FIG. 3
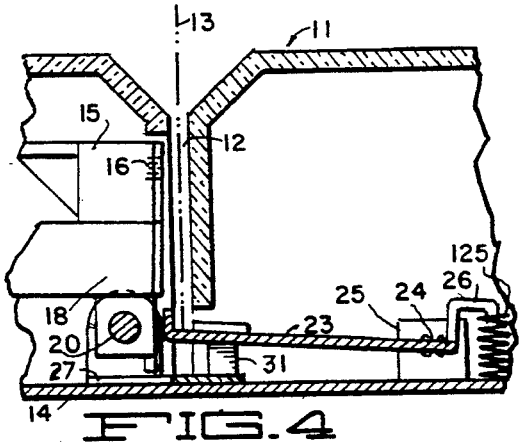
FIG. 4
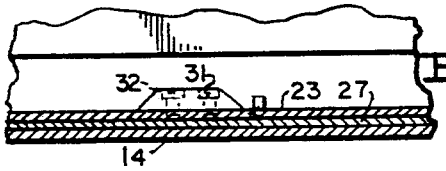
FIG. 5
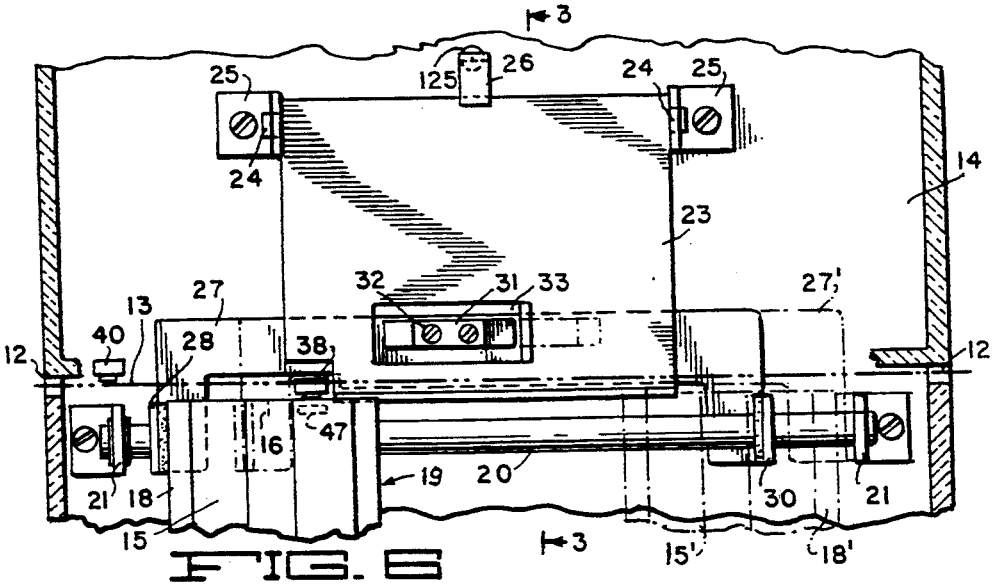
FIG. 6

DUAL LINE SLIP PRINTER

BACKGROUND OF THE INVENTION

I. Field of the Invention

This invention relates to printers and has particular reference to a serial data printer for printing a pair of lines of type characters on slips, forms or the like.

II. Description of the Prior Art

Records of business transactions or other operations are often printed on individual slips or forms. For example, in banking transactions, records of depositors transactions may be printed on separate slips and given to the depositors as records of their deposits.

In my co-pending patent application, Ser. No. 7/993,354, filed Dec. 12, 1992, I have disclosed and claimed a slip printer using a serial printer head which is capable of printing two or more lines of print on the same slip. The printer works satisfactory. However, it requires one or more feed rollers driven by a suitable motor through entrained gearing to advance the slip from one print line position to another. Means are also required to ensure adequate frictional gripping of the feed roller against the slip to ensure proper line spacing.

SUMMARY OF THE INVENTION

A principal object of the present invention is to provide a dual line serially operable slip printer which obviates the need for providing a motor driven feed roller or rollers to advance the slip.

Another object is to provide a printer of the above type with means operable by the printer during its excursion along the slip for positively advancing the slip from one print line position to a next.

Another object is to provide a printer of the above type which is small, compact and yet highly reliable.

A further object is to provide a slip printer of the above type having very few parts and which is inexpensive to manufacture and assemble.

According to the invention, a slip printer is provided having a chute in which a slip or the like is dropped. A serially operable print head device is moved along the length of the slip to print a line of type characters. A slip supporting member is provided upon which the slip rests. The print head device advances along the slip and when it reaches the end of its travel, it actuates a camming member which is effective to cam the slip supporting member from one position to another to move the slip to a second level so that upon return of the print head device to its initial position, it will print a second row of type characters spaced vertically from the first.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a perspective view of a slip printer embodying a preferred form of the present invention.

FIG. 2 is a front view of a typical slip, partly broken away, printed by a printer of the present invention.

FIG. 3 is a transverse sectional view, partly broken away, of the printer and is taken along line 3—3 of FIG. 6.

FIG. 4 is a sectional view similar to that of FIG. 3 but showing the parts in alternate positions.

FIG. 5 is a fragmentary sectional view taken along line 5—5 of FIG. 3.

FIG. 6 is a sectional plan view partly broken away, taken along line 6—6 of FIG. 3.

DESCRIPTION OF THE PREFERRED EMBODIMENT

Figure 7:
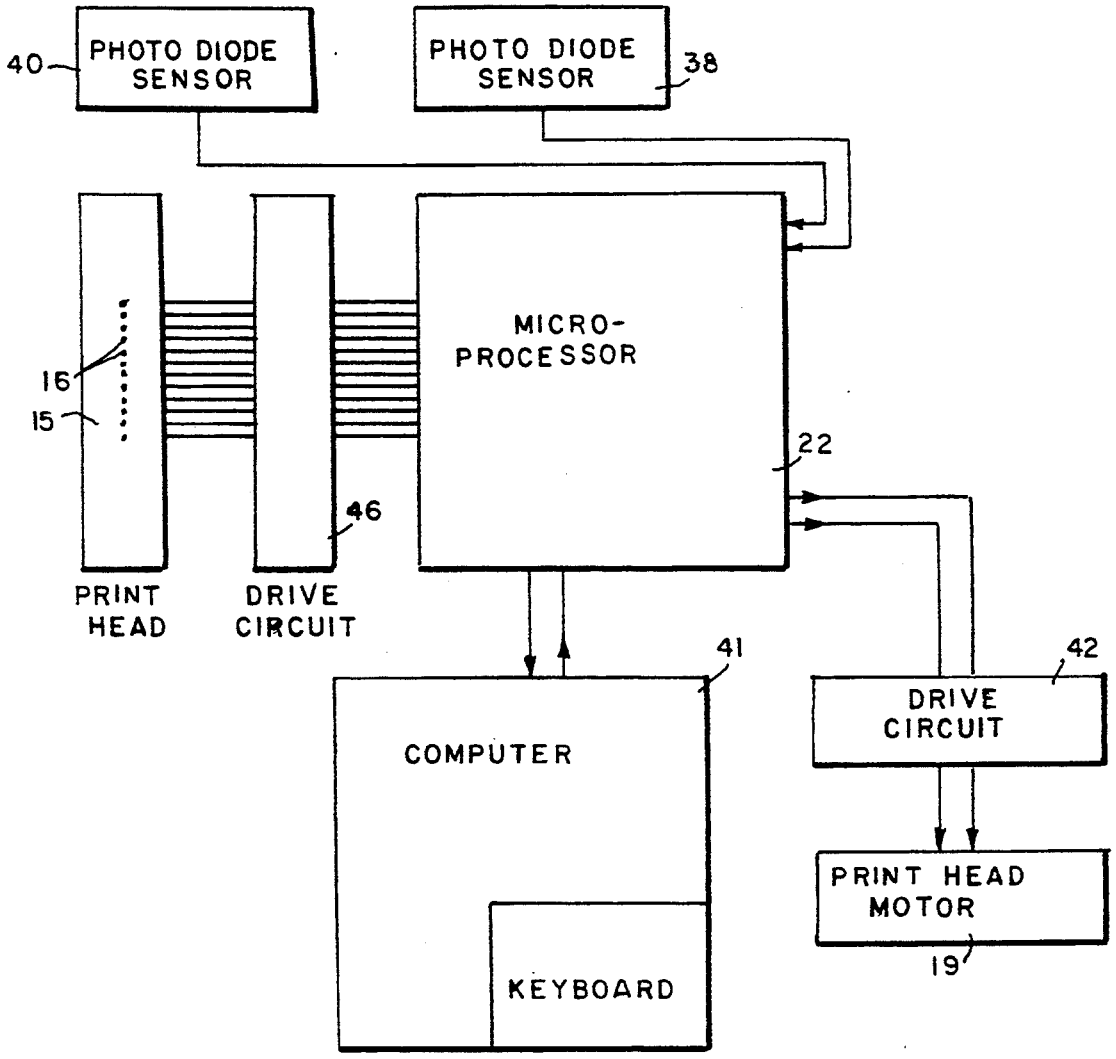
FIG. 7 is a block diagram showing the controls for the printer.

While this invention can be embodied in many different forms, there is shown in the drawings a preferred form but it is to be understood that the present disclosure is to be considered only as an exemplification of the principles of the invention and is not intended to limit the same to the embodiment shown therein. The scope of the invention will be pointed out in the appended claims.

Referring to the drawings, the printer is housed in a casing generally indicated at 11. The latter has vertical slots 12 along opposite sides thereof which form a chute to receive a record slip or form 13 which may be of any appropriate size. The slots 12 extend downwardly to approximately the level of a floor plate 14 which is suitably secured in a manner not shown within the casing 11 and which supports various parts of the printer.

A printer device, generally indicated at 19', is provided comprising a serially operable inkjet print head 15 effective to print a line of type characters along a portion of the length of the inserted slip 13. Such print head is of conventional construction and may obtained from the Hewlett Packard Company of Palo Alto, Calif., as part number HP51604A.

The print head 15 has a plurality of vertically aligned minute inkier nozzles indicated by dotted lines 16 (FIGS. 3, 4 and 6) which can be individually controlled to impel minute globules of ink in appropriate patterns against the surface of the slip as the print head is moved along the length of the slip to form a row of type characters shown, for example, at 17 in FIG. 2.

The print head 15 is carried by a carriage 18 which is slidably mounted on a stationary rod 20 supported between brackets 21 extending upwardly from the floor plate 14.

The print head 15 and its carriage 18 are movable along the rod 20 between their full line positions shown in FIG. 6 and their dotted line positions 15' and 18' by a suitable bidirectional stepper motor diagrammatically indicated at 19 (FIG. 7) under control by a microprocessor 22 as will appear later.

A support plate 23 is provided to underlie and support an inserted slip 13. Plate 23 is pivoted at 24 to brackets 25 upstanding from the floor plate 14 for movement about a horizontal axis. A compression spring 125 extends between the floor plate and a tail 26 on the plate 23 to urge the plate counterclockwise to engage a cam plate 27. The latter is slidably mounted on the floor plate 14 and is provided with upstanding ears 28 and 30 at opposite ends which are slidable along the rod 20. A cam 31 is secured to the plate 27 by screws 32 and normally, when the cam plate 27 is in its initial position shown by full lines in FIG. 6, the cam is located in an opening 33 formed in the support plate 23.

Accordingly, when the print head 15 is in its initial position shown in FIG. 6, the support plate 23 allows the slip 13 to assume its lower level shown in FIG. 3. Therefore, when a printing operation is initiated, the print head 15 will be advanced to the right in FIG. 6 along the rod 20 toward its alternate position 15' during which a row of type characters, i.e., 17 (FIG. 2) will be printed. As the print head nears its right hand position 15', the carriage 18 engages the ear 30 of cam plate 27, moving it into an alternate righthand position shown by dot-dash lines 27', causing the cam 31 to cam support member 23 clockwise into its upper position shown in FIG. 4. The latter thus raises the slip 13 into its upper level shown in FIG. 4 and holds it there. Thus, during the return movement of the print head 15 to the left in FIG. 6, a second row of type characters, i.e. 37, may be printed below the first row 17.

As print head 15 nears its lefthand position, carriage 18 engages the ear 28 of cam plate 27, returning it to its full line position of FIG. 6, thereby allowing the cam 31 to recede from under the support plate 23 and permitting spring 125 to lower the support plate to its initial support position of FIG. 3.

A photo diode sensor 38 responsive to a shutter 47 on the print head carriage 18 is provided to sense the position of the print head 15 and a second sensor 40 is provided to sense the positioning of a slip 13 in the chute 12.

OPERATION

When a slip 13 is dropped into the chute 12 it controls the sensor 40 (see also FIG. 7) which signals the microprocessor 22 to enable a micro computer 41 and to apply a signal to a drive circuit 42 to energize the print head drive motor 19 causing it to advance the print head 15 to the right along the length of the slip.

As the print head 15 moves from its left hand position, shutter 47 on the printer carriage 18 moves out a blocking relation to sensor 38, causing a signal to be applied to the processor 22 to cause data from the computer 41 to be applied through drive circuits 46 to energize various ones of the inkjet nozzles 16 in proper order to print a line of readable type characters, i.e. 17, along the slip 13.

Thereafter, and after the print head 15 has reached the righthand limit of its travel, the stepper motor 19 will return the print head to the left toward its initial position. During this travel the computer 41 again applies data signals through the micro-processor 22 to energize the inkjet nozzles 16 to print the second row, i.e. 37, of type characters on the slip 13.

As the print head 15 moves into its lefthand initial position, shutter 47 causes sensor 38 to apply a signal to the micro-processor 22 to de-energize the stepper motor 19, ready for a subsequent printing operation.

The spacing between the lines 17 and 37 of type characters may be varied by substituting cams of different heights for cam 31.

From the above it will be seen that I have devised an extremely simple, compact and inexpensive serially operable slip printer for printing a pair of separate lines on an inserted slip or the like. It will also be seen that the printer provides a means for positively positioning a slip in either of two line printing positions and obviates the need for any paper feed rollers and accompanying driving mechanism.

I claim:

1. A printer for printing data on a record slip having a bottom edge, comprising means for guiding said slip in a vertical plane, means including a slip supporting member engaging said bottom edge to support said slip at a first level;

a serially operable printer device, means for moving said printer device in a first direction along said slip to print a first row of type characters and for thereafter moving said printer device in an opposite direction to print a second row of type characters, actuating means responsive to said printer device upon reaching a first predetermined position during movement in one of said directions for causing said supporting member to move said slip in said plane to a second level whereby said second row of type characters is spaced vertically relative to said first row, and said actuating means comprises an operating device operable by said printer device upon reaching said first predetermined position for causing movement of said supporting member to support said slip at said second level and said operating device comprises a cam engageable with said supporting member.

2. A printer as defined in claim 1 wherein said actuating means is responsive to said printer device upon reaching a second predetermined position for causing said supporting member to support said slip at said first level.

3. A printer as defined in claim 1 comprising spring means for moving and maintaining said supporting member to support said slip at said first level.

4. A printer for printing data on a record slip having a bottom edge, comprising means forming a vertically extending chute for receiving said slip, a slip supporting member engagable with said bottom edge of said slip, a serially operable printer device, means for moving said printer device in a first direction along said slip to print a first row of type characters and for moving said printer device in the opposite direction to print a second row of type characters, said supporting member being movable between a first position to position said slip at a first level and to a second position to support said slip at a second level, an actuating member operable by said printer device upon movement of said printer device to a first predetermined location in said first direction to cause said supporting member to move into said first position, said actuating member being operable by said printer device upon movement of said printer device to a second predetermined location in said opposite direction to cause said supporting member to move into said second position, and said actuating member comprises a cam in camming relation to said supporting member.

* * * * *